United States Patent [19]

Hallman et al.

[11] Patent Number: 4,844,691

[45] Date of Patent: Jul. 4, 1989

[54] CENTRIFUGAL LIQUID PUMP WITH CAVITATION SURGE SUPPRESSION

[75] Inventors: John H. Hallman; Theodore C. Powers; Peter B. Thomas, Jr., all of Rockford, Ill.

[73] Assignee: Sundstrand Corporation, Rockford, Ill.

[21] Appl. No.: 139,384

[22] Filed: Dec. 30, 1987

[51] Int. Cl.[4] ..... F01D 25/32

[52] U.S. Cl. ..... 415/169.1; 55/203; 55/409

[58] Field of Search ..... 415/168, 121 A; 55/203, 55/409

[56] References Cited

U.S. PATENT DOCUMENTS

| | | | |
|---|---|---|---|
| 2,422,956 | 6/1947 | Edwards | 55/199 |
| 2,463,251 | 3/1949 | Curtis | 318/466 |
| 2,758,815 | 8/1956 | Fontaine et al. | 415/168 |
| 2,985,108 | 5/1961 | Stoner et al. | 55/199 |
| 3,188,968 | 6/1965 | McMahan | 415/100 |
| 3,213,797 | 10/1965 | McMahan | 417/357 |
| 3,257,782 | 6/1966 | Weiss | 55/409 |
| 3,982,913 | 9/1976 | Feichtinger | 55/409 |
| 4,273,562 | 6/1981 | Niskanen | 55/52 |
| 4,410,337 | 10/1983 | Gullichsen et al. | 55/203 |
| 4,645,518 | 2/1987 | Roffelsen | 415/121 A |

FOREIGN PATENT DOCUMENTS

| | | | |
|---|---|---|---|
| 1061171 | 4/1954 | France | 55/409 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

A centrifugal liquid pump includes an impeller and a hub for the impeller, whereby gases entrained in the liquid are separated from the liquid and collect near the hub by centripetal action. A shaft is connected to the hub for rotating the impeller, and a passageway extends axially through the shaft. A gas entry is provided near the hub in communication with the passageway. An air pump is provided at an opposite end of the shaft for evacuating the separated gases collected near the hub. The air pump is independent of and remote from the impeller and is in communication with the passageway extending axially through the shaft.

15 Claims, 3 Drawing Sheets

CENTRIFUGAL LIQUID PUMP WITH CAVITATION SURGE SUPPRESSION

FIELD OF THE INVENTION

This invention generally relates to centrifugal liquid pumps and, particularly, to a system for removing vapor collected in the pump when separated from the liquid.

BACKGROUND OF THE INVENTION

A conventional centrifugal liquid pump includes an impeller on a hub for pumping liquid from an inlet to the impeller to a pump outlet. Many such liquid centrifugal pumps experience the creation of vapor bubbles (cavitation) in the vicinity of the impeller hub. It has been observed that at low inlet pressures and flow rates this cavitation introduces discharge pressure variations and thus input power variations, sometimes called cavitation surges. In essence, the surge is caused by a core of vapor at the hub of the impeller, usually at the inlet area. The vapor is generated by the blade tips and collects at the hub due to centrifugal force acting on the more dense liquid.

This invention is directed to solving the above problems and suppressing cavitation surge in a centrifugal liquid pump.

SUMMARY OF THE INVENTION

An object, therefore, of the invention is to provide a new and improved means for removing generated vapor from the vicinity of an impeller hub in a liquid centrifugal pump.

In the exemplary embodiment of the invention, a centrifugal liquid pump is shown to include an impeller and a hub for the impeller. Gas entrained in the liquid is separated from the liquid and collects near the hub by centripetal action. The pump includes shaft means connected to the hub for rotating the impeller. Passageway means extend axially through the shaft. Gas entry means are provided near the hub in communication with the passageway means. Air pump means are provided independent of and remote from the impeller for evacuating the separated gases collected near the hub. The air pump means is in communication with the passageway means extending axially through the shaft means.

As disclosed herein, the air pump means is of a vacuum type, such as a ring pump. The impeller is located near one end of the shaft means and the ring pump is located near an opposite end of the shaft means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
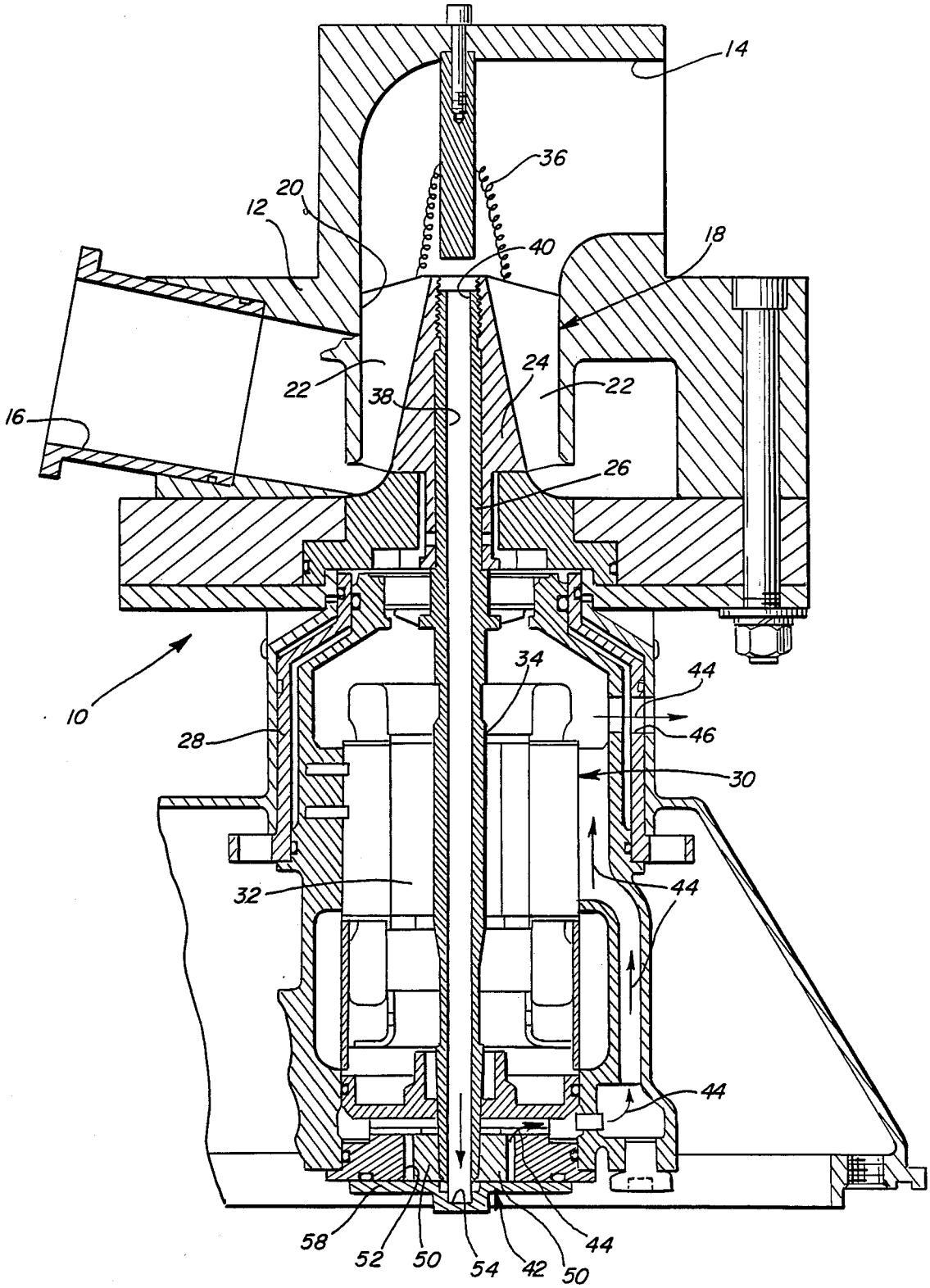
FIG. 1 is an axial section through a centrifugal liquid pump embodying the concepts of the invention.

Referring to the drawings in greater detail, a centrifugal liquid pump is illustrated and generally designated 10. The pump includes an impeller housing 12 defining a liquid pump inlet 14 and a liquid pump outlet or discharge 16. An impeller, generally designated 18, is rotatably mounted within a pumping chamber 20 within impeller housing 12 between inlet 14 and outlet 16. The impeller includes impeller blades 22 surrounding an impeller hub 24. A shaft 26 is connected to impeller hub 24 for rotating impeller 18.

A motor housing 28 is located below impeller housing 12 for mounting therewithin a conventional dynamoelectric motor means, generally designated 30. A rotor 32 of the motor is splined to shaft 26, as at 34, for rotating the shaft and thereby rotating impeller 18.

The invention contemplates a novel system for removing generated vapor from the vicinity of the impeller hub. Specifically, a core 36 of vapor is generated around hub 24, particularly at the inner end thereof, and the vapor will migrate downwardly about the hub between the roots of impeller blades 22. This vapor is generated by the blade tips and collects at the hub due to centrifugal force acting on the more dense liquid.

The invention contemplates the use of a generally hollow shaft so as to define a passageway 38 extending axially through the shaft. The shaft is open at its upper end, as at 40, to define a gas entry near the hub in communication with passageway 38. Air pump means, generally designated 42, is secured to shaft 26 at the lower end thereof, independent of and remote from impeller 18. Generally, air pump means 42 is effective to evacuate the separated gases collected near impeller hub 24. The air pump means is in communication with passageway 38 extending axially through the shaft to the core 36 of collected vapor. The air pump means, in essence, creates a vacuum at entry 40 to passageway 38, draws the vapor from core 36, and propels the vapor through suitably situated passageways in motor housing 28, as indicated by arrows 44, through an outlet 46 in the motor housing, and to an appropriate liquid tank. In the case of the pump pumping fuel, the vapor simply is propelled back to the fuel tank. It should be evident from FIG. 1 that the air pump means 42 is sized so that at operating speed, its pumping power is sufficient to remove vapor from core 36. However, because it is only an air pump, its pumping capacity is insufficent to draw any liquid from core 36. Therefore, should no vapor filled cavity exist at impeller hub 24, the air pump means 42 will cease to pump. It is undesirable to have air pump means 42 pump liquid from the impeller hub 24, because (1) only gas that is at impeller hub 24, is unwanted, and (2) the horsepower that the pump would have to draw while removing liquid from the impeller hub 24 decreases the efficiency of the pumping performed by the impeller 18.

Figure 3:
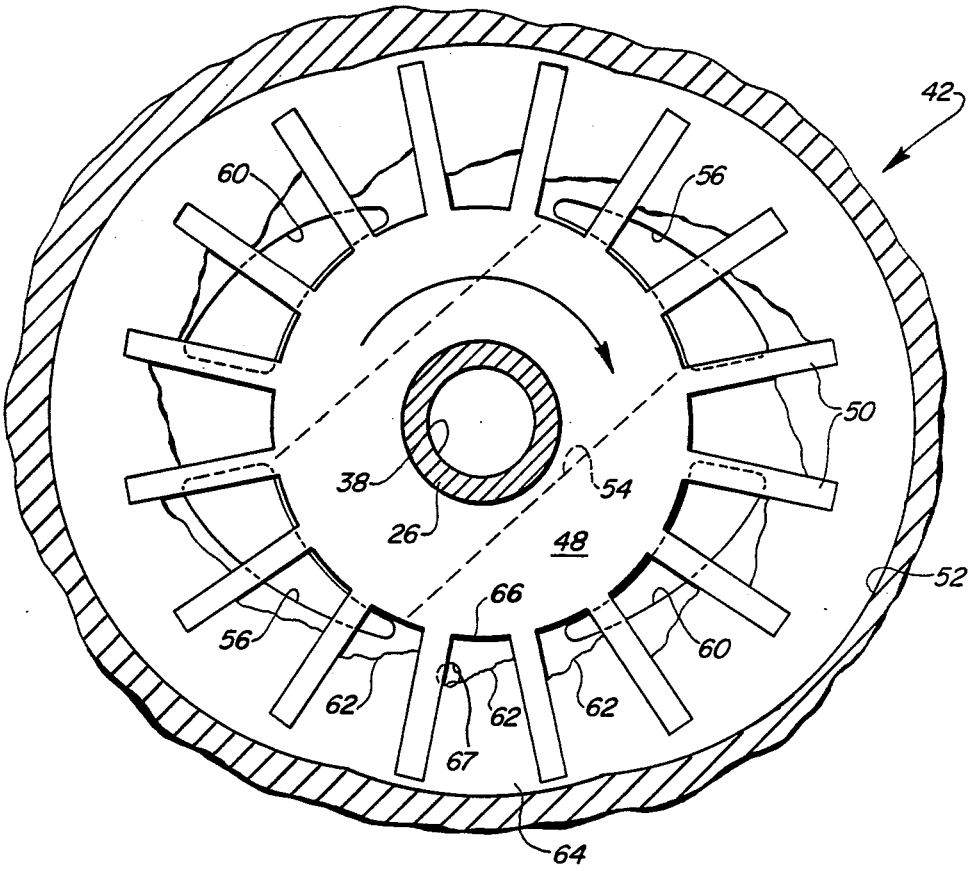
FIG. 3 is a somewhat schematic illustration of the ring pump for evacuating separated gases collected near the impeller hub of the centrifugal liquid pump.

FIG. 3 shows somewhat schematically a vacuum-type air pump means in the form of a ring pump for application, as at 42, in centrifugal liquid pump 10 of FIG. 1. More particularly, shaft 26 is shown to include axially extending passageway 38. A rotor 48 of the ring pump is secured to shaft 26 for rotation therewith. Pump blades 50 radiate outwardly from rotor 48. A bore 52 defines a pumping cavity surrounding the rotor and pump blades. Bore 52 and two blades 50 are seen in FIG. 1. Also shown in FIG. 1 is a cross passage 54 beneath rotor 48 as illustrated by dotted lines in FIG. 3. Passage 54 communicates with axial passageway 38 of shaft 26 and also communicates with inlet ports 56 defined in a bearing plate 58 (FIG. 1) at the bottom of the ring pump. Therefore, vapor is drawn from about impeller hub 24 downwardly through shaft passageway 38 into cross passageway 54 and upwardly between blades 50 by means of inlet ports 56 provided beneath the blades adjacent the roots thereof.

FIG. 3 is somewhat of a schematic illustration in that it shows discharge ports 60 angularly spaced between inlet ports 56, but the discharge ports are located at the top of blades 50 as viewed in FIG. 1, whereby the vapor is propelled through the discharge ports and outwardly of motor housing 28 in the direction of arrows 44 through suitably situated passages in the motor housing.

FIG. 3 also shows interface lines 62 between liquid 64 and gas 66 disposed about ring pump 42 between adjacent blades 50. Such ring pumps require an amount of such liquid to be disposed inwardly of the blade tips in order for the pump to properly operate as an air pump. Should the air migrate beyond the blade tips, of course, there would be no pumping action. The liquid is accumulated in the ring pump by small amounts of liquid entrained in the vapor which is drawn from vapor core 36. In addition, a liquid ring charge port 67 is provided at a desired radial location at the op of the rotor and the pump blades to drain a small amount of liquid from the motor housing as the liquid seeps thereinto. The charge pump port is located at a radial point, as desired, to insure an amount of liquid between the pump blades. Should the charge port be covered with liquid, of course, no liquid could drain into the ring pump because of the higher pressure therein on the rotating liquid. Excess liquid simply is discharged by the pump through discharge ports 60 and back to the liquid tank.

Figure 2:
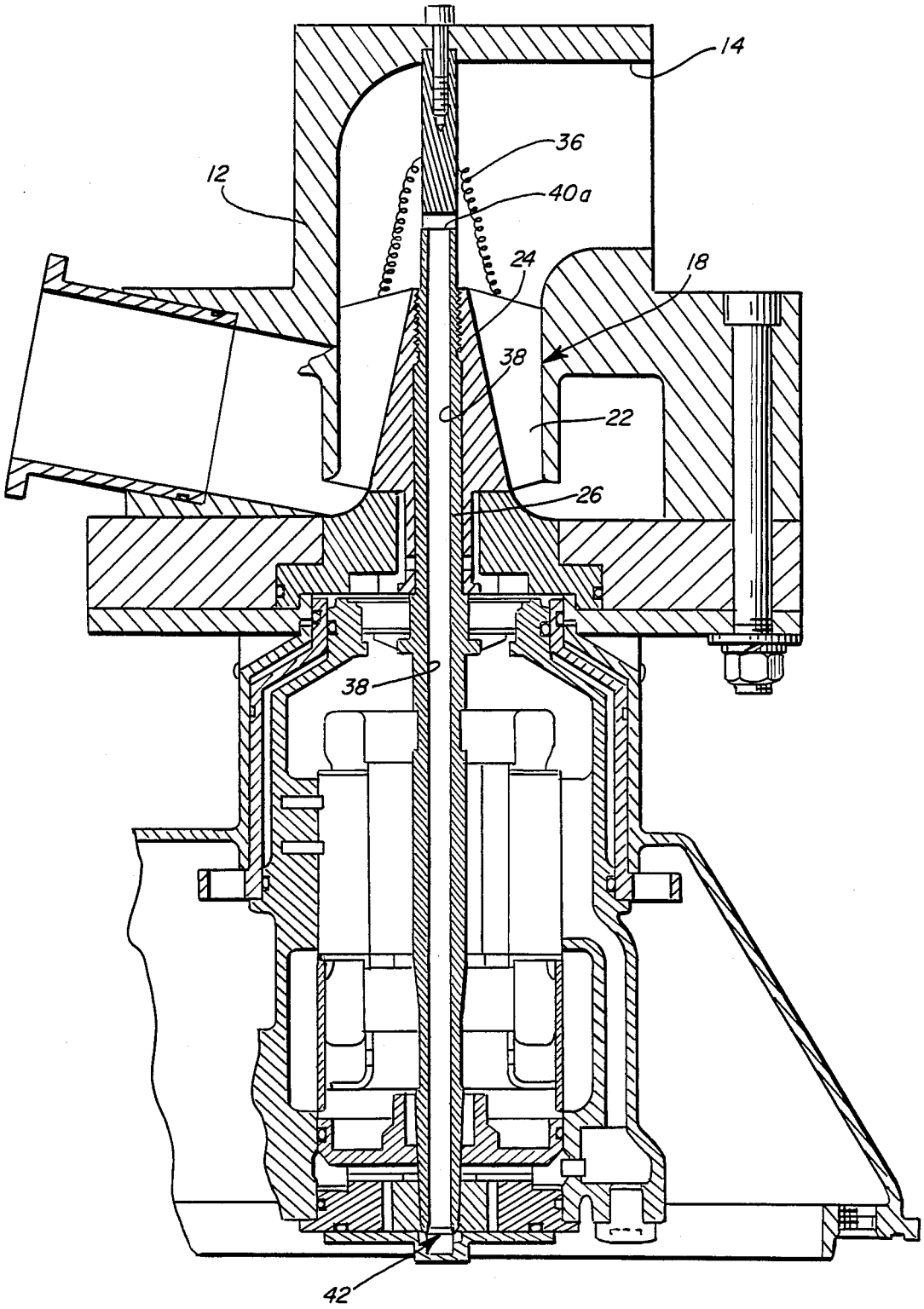
FIG. 2 is a view similar to that of FIG. 1, illustrating a modified form of the invention.

FIG. 2 shows an alternate form of the invention wherein a gas entry is formed by a right-angularly oriented opening 40*a* in shaft 26 above impeller hub 24 in the core 36 of vapor. The opening is in communication with passageway 38 to air pump means 42. This form has proven to be quite efficient in operation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a centrifugal liquid pump having an impeller and a hub for the impeller, gases entrained in the liquid being separated from the liquid and being collected near the hub by centripetal action, shaft means connected to the hub for rotating the impeller, passageway means extending axially through the shaft, gas entry means near the hub in communication with the passageway means, and air pump means independent of and remote from the impeller for evacuating only the separated gases collected near the hub, the air pump means being in communication with the passageway means extending axially through the shaft means, said air pump means creating a vacuum in said passageway to thereby draw said gas near said hub through said passageway and propel said gas away.

2. In a centrifugal liquid pump as set forth in claim 1, wherein said air pump means is of a vacuum type.

3. In a centrifugal liquid pump as set forth in claim 2, wherein said air pump means comprises a ring pump.

4. In a centrifugal liquid pump as set forth in claim 1, wherein said impeller is located near one end of the shaft means and the air pump means is located near an opposite end of the shaft means.

5. In a centrifugal liquid pump as set forth in claim 4 wherein said one end of the shaft means extends beyond the impeller and said gas entry means is located in the shaft means beyond the impeller.

6. In a centrifugal liquid pump as set forth in claim 5 wherein said gas entry means extends perpendicular to the shaft means.

7. In a centrifugal liquid pump as set forth in claim 1, wherein said gas entry means is located near one end of the shaft means and the air pump means is located near an opposite end of the shaft means.

8. In a centrifugal liquid pump as set forth in claim 1 wherein one end of the shaft means extends beyond the impeller and said gas entry means is located in the shaft means beyond the impeller.

9. In a centrifugal liquid pump as set forth in claim 8 wherein said gas entry means extends perpendicular to the shaft means.

10. In a centrifugal liquid pump as set forth in claim 1 wherein said gas entry means extends perpendicular to the shaft means.

11. In a centrifugal liquid pump which includes an impeller and a hub for the impeller whereby gases entrained in the liquid are separated from the liquid and collected near the hub by centripetal action, and a shaft connected to the hub for rotating the impeller, the improvement comprising a passageway extending axially through the shaft, gas entry means near the hub in communication with the passageway, and an air pump for evacuating the separated gases collected near the hub, the air pump being independent of and remote from the impeller and being in communication with the passageway extending axially through the shaft, said air pump creating a vacuum in said passageway to thereby draw said gas near said hub through said passageway and propel said gas away.

12. The improvement of claim 11, wherein said air pump is of a vacuum type.

13. The improvement of claim 12, wherein said air pump comprises a ring pump.

14. The improvement of claim 11, wherein said impeller is located near one end of the shaft and the air pump is located near an opposite end of the shaft.

15. The improvement of claim 11, wherein said gas entry means is located near one end of the shaft and the air pump is located near an opposite end of the shaft.

* * * * *